US007859404B2

(12) United States Patent
Chul Lee et al.

(10) Patent No.: US 7,859,404 B2
(45) Date of Patent: Dec. 28, 2010

(54) METHOD AND APPARATUS FOR PROXIMITY ACTIVATED RFID SYSTEM

(75) Inventors: Steven Seung Chul Lee, Richmond Hill (CA); Jake Choy, North York (CA)

(73) Assignee: Tyco Safety Products Canada Ltd., Concord, Ontario (CA)

( * ) Notice: Subject to any disclaimer, the term of this patent is extended or adjusted under 35 U.S.C. 154(b) by 274 days.

(21) Appl. No.: 12/141,574

(22) Filed: Jun. 18, 2008

(65) Prior Publication Data

US 2009/0243837 A1 Oct. 1, 2009

Related U.S. Application Data

(60) Provisional application No. 61/039,191, filed on Mar. 25, 2008.

(51) Int. Cl.
*G08B 1/08* (2006.01)

(52) U.S. Cl. ..... 340/539.19; 340/539.23; 340/5.61; 340/425.5; 340/501; 340/506; 340/531; 340/545.1; 340/545.7; 340/572.1; 340/572.7; 340/572.8; 340/693.3

(58) Field of Classification Search ..... 340/539.19, 340/539.23, 5.61, 426.6, 501, 506, 531, 545, 340/1, 545.7, 572.1, 572.7, 572.8, 693.3
See application file for complete search history.

(56) References Cited

U.S. PATENT DOCUMENTS 5,541,585 A * 7/1996 Duhame et al. ..... 340/5.62
6,150,948 A 11/2000 Watkins
7,023,341 B2 4/2006 Stilp
2003/0006879 A1* 1/2003 Kang et al. ..... 340/5.61
2005/0162254 A1* 7/2005 Michishige et al. ..... 340/5.61
2005/0174218 A1 8/2005 Jordan et al.
2005/0264411 A1 12/2005 Katz
2008/0055040 A1 3/2008 Lizza et al.
2008/0100448 A1 5/2008 Sharma

FOREIGN PATENT DOCUMENTS

WO WO 02/25040 A1 3/2002

* cited by examiner

*Primary Examiner*—Tai T Nguyen
(74) *Attorney, Agent, or Firm*—The Smallest Patent Law Group LLP

(57) ABSTRACT

A security system comprises a control panel configured to control devices in a security system, a keypad and an arm/disarm device. The keypad is in communication with the control panel and comprises a transceiver configured to communicate with the control panel and a magnet having a magnetic field extending within a predetermined proximity of the keypad. The arm/disarm device comprises a transmitter and a switch configured to activate the transmitter when the switch is in the magnetic field. The transmitter is further configured to transmit a low power signal when activated. The transceiver is further configured to receive the low power signal and transmit a message to the control panel. The control panel is further configured to change an Armed/Disarmed Mode of the system based on the message.

9 Claims, 4 Drawing Sheets

METHOD AND APPARATUS FOR PROXIMITY ACTIVATED RFID SYSTEM

CROSS REFERENCE TO RELATED APPLICATIONS

The application relates to and claims priority from provisional patent application Ser. No. 61/039,191,titled "PROXIMITY ACTIVATED RFID SYSTEM", filed Mar. 25, 2008, the complete subject matter of which is expressly hereby incorporated herein in its entirety.

BACKGROUND OF THE INVENTION

This invention relates generally to security systems, and more particularly to using an arm/disarm device to arm and disarm the security system.

Keypads are often located at secured doors and may be used to enter in codes to arm and disarm a security system. A keypad transceiver is used to communicate with the control panel of the security system. The keypad transceiver and associated electronics are in an ON or activated state to constantly scan for input from the surrounding, environment. Radio frequency identification (RFID) readers are often incorporated into the keypads for reading RFID tags or keytags that are carried by users of the system and, used to arm and disarm the system. The RFID tags may be active tags that are battery powered or passive tags that are powered by the RFID reader. Active tags transmit. RF packets at regular intervals at relatively high power, consuming approximately 25 milliamps (mA) or more per transmission. This shortens the life of the active tag.

It is often desirable to have the keypad communicate wirelessly with the control panel of the security system. In such a wireless environment, the keypad may be battery powered. For a typical RFID reader circuit, the transmit current may be close to 70 mA. Therefore, the RFID reader cannot be turned on all the time as the battery life would not be acceptable for a typical wireless application. However, the RFID reader has to be ON or activated to detect the RF packets, as well as to power the, passive tags if needed.

Battery life of the RFID reader may be conserved by having a user press a key on the keypad to wake up the RFID reader. The user may then present the RFID tag close to the RFID reader, or some RFID tags may be read or sensed while in the user's pocket, purse, backpack and the like. However, it is desirable for the keypad to conserve battery power while sensing the RFID tag without the user having to go through the extra step of pressing a button to initiate the operation.

BRIEF DESCRIPTION OF THE INVENTION

In one embodiment, a security system comprises a control panel configured to control devices in a security system, a keypad and an arm/disarm device. The keypad is in communication with the control panel and comprises a transceiver configured to communicate with the control panel and a magnet having a magnetic field extending within a predetermined proximity of the keypad. The arm/disarm device comprises a transmitter and a switch configured to activate the transmitter when the switch is in the magnetic field. The transmitter is further configured to transmit a low power signal when activated. The transceiver is further configured to receive the low power signal and transmit a message to the control panel. The control panel is further configured to change an Armed/Disarmed Mode of the system based on the message.

In another embodiment, a method for arming and disarming an alarm system comprises automatically activating an arm/disarm device when the arm/disarm device is within a predetermined proximity of a keypad. A device packet is transmitted with a low level of transmit power from the arm/disarm device to the keypad. The device packet is detected at the keypad. A message is transmitted based on the device packet from the keypad to a control panel, and an Armed/Disarmed Mode of the alarm system is changed based on the message.

In yet another embodiment, a security system comprises a control panel configured to control devices in a security system. A keypad in communication with the control panel comprises a transceiver and a passive infrared (PIR) sensor configured to detect temperature within a predetermined proximity of the PIR sensor. The transceiver transmits an RF signal when the PIR sensor detects a minimum temperature change. An arm/disarm device is configured to receive the RF signal from the transceiver. The arm/disarm device comprises a transmitter configured to transmit a low power RF device packet to the transceiver. The low power RF device packet comprises at least one identifier for identifying the arm/disarm device. The keypad is further configured to transmit a message to the control panel based on the low power RF device packet, and the control panel is further configured to determine one of an Armed. Mode and Disarmed Mode for the system based on the message.

DETAILED DESCRIPTION OF THE INVENTION

Figure 1:
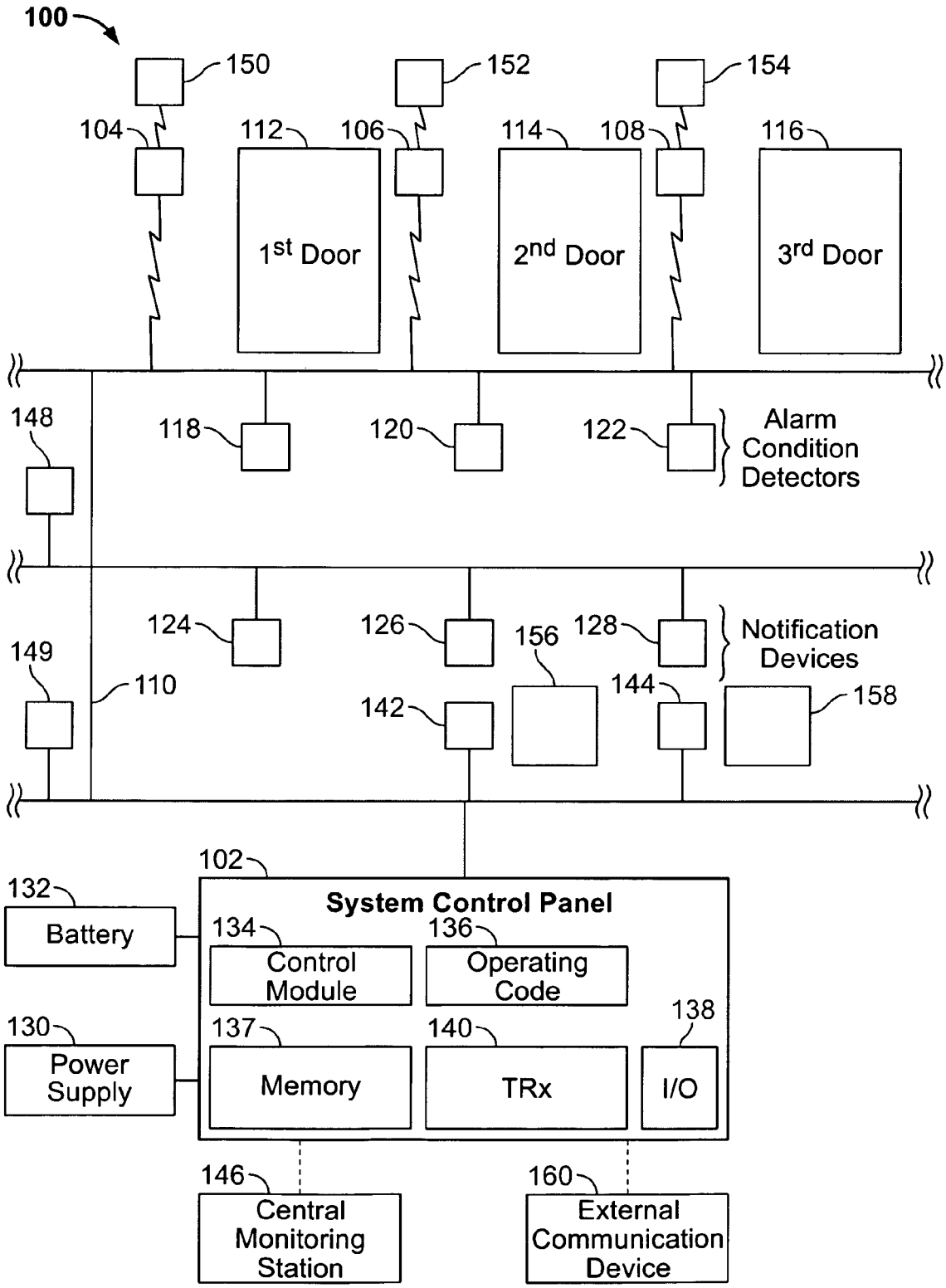
FIG. 1 illustrates a security system that has a system control panel for monitoring and/or controlling devices installed on a network in accordance with an embodiment of the present invention.

The foregoing summary, as well as the following detailed description of certain embodiments of the present invention, will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (e.g., processors or memories) may be implemented in a single piece of hardware (e.g., a general purpose signal processor or random access memory, hard disk, or the like). Similarly, the programs may be stand alone programs, may be incorporated as subroutines in an operating system, may be functions in an installed software package, and the like. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

FIG. 1 illustrates a security system 100 that has a system control panel 102 for monitoring, and/or controlling devices installed on a network 110. The network 110 may be wireless or wired or a combination thereof. The devices may detect and/or control door openings and closings, detect motion, detect alarm conditions, notify people within an area about alarm conditions, or accomplish other functions that may be desired. For example, the system 100 may be used to monitor premises such as a boat, office suite, industrial building, residence, and the like.

The system 100 has one or more keypads, such as first keypad 104, second keypad 106 and third keypad 108, which may be configured to monitor first door 112, second door 114, and third door 116, respectively. It should be understood that there may be more or less keypads 104-108 in a system 100. The first through third keypads 104-108 communicate wirelessly with the system control panel 102 over the network 110. Each of the keypads 104, 106, and 108 has a unique address on the network 110.

Each of the first through third keypads 104-108 is configured to receive signals from one or more arm/disarm devices, 150, 152 and 154, which may also be referred to as RFID tags or keytags. By way of example only, the signals may be electrical signals, radio frequency (RF) signals, RF packets, RF energy, and the like. In some embodiments, the first through third keypads 104-108 may transmit RF energy, RF packets, and/or signals to the arm/disarm devices 150-154.

The arm/disarm device 150-154 is typically carried by a person and is used to arm or disarm the system 100. The arm/disarm devices 150-154 may be small in size and easily portable, such as in a pocket, briefcase, purse., backpack and the like. There may be multiple arm/disarm devices 150-154 configured to communicate with the system 100, and each of the arm/disarm devices 150-154 may have a, unique device identifier (ID), code or password associated therewith, such that the system 100 can determine which particular arm/disarm device 150-154 is used. Alternatively, all or some of the arm/disarm devices 150-154 configured to work with the system 100 may have the same device ID, code or password.

Turning to the devices used to detect conditions within the premises, first and second window sensors 142 and 144 may monitor first and second windows 156 and 158 for unauthorized opening or glass breaking. Also, one or more motion sensors 148 and 149 may be used to detect motion. Alarm condition detectors 118, 120 and 122 may be connected on the network 110 and are monitored by the system control panel 102. The detectors 118-122 may detect fire, smoke, temperature, chemical compositions, or other hazardous conditions. When an alarm condition is sensed, the system control panel 102 transmits an alarm signal to one or more addressable notification device 124, 126 and/or 128 through the network 110. The addressable notification devices 124, 126 and 128 may be horns and/or strobes, for example.

The system control panel 102 is connected to a power supply 130 that provides one or more levels of power to the system 100. A transceiver 140 communicates wirelessly with the first through third keypads 104-108 and other devices that may be configured to communicate wirelessly. In some embodiments, the transceiver 140 may communicate with one or more of the first through third keypads 104-108 over a wired connection. One or more batteries 132 may provide a back-up power source for a predetermined period of time in the event of a failure of the power supply 130 or other incoming power. Other functions of the system control panel 102 may include displaying the status of the system 100, resetting a component, a portion, or all of the system 100, silencing signals, turning off strobe lights, and the like.

The network 110 is configured to carry power and communications to the addressable notification devices 124-128 from the system control panel 102. Each addressable notification device 124-128 has a unique address and may be capable of communication with the system control panel 102. The addressable notification devices 124-128 may communicate their status and functional capability to the system control panel 102 over the network 110.

The system control panel 102 has a control module 134 that provides control software and hardware to operate the system 100. Operating code 136 may be provided on a hard disk, ROM, flash memory, stored and run on a CPU card, or other memory. An input/output (I/O) port 138 may provide a, communication interface at the system control panel 102 for communicating with an external communication device 160 such as a laptop computer.

A central monitoring station 146 may receive communications from the system control panel 102 regarding security problems and alarm conditions. The central monitoring station 146 is, typically located remote from the system 100 and provides monitoring to many security systems.

During normal operation, the security system 100 may be set in several modes, such as Armed Mode and Disarmed Mode. Other modes of operation may be used. Armed Mode may arm all or a predetermined subset of the security features, while Disarmed. Mode may disarm all or a predetermined subset of the security features. For example, alarm condition detectors 118-122 and notification devices 124-128 may always be armed.

The keypads 104-108 operate primarily in a periodic polling mode to conserve power. During the periodic polling mode,, the keypad 104-108 wakes up periodically, such, as every 400 ms to 500 ms, for a short time period, such as two to five ms, to scan the environment for RF stimulus, such as an RF packet. If an RF stimulus is detected, the keypad 104-108 may be activated to transmit, receive and/or process signals and/or RF packets of data. When the arm/disarm device 150-154 is held in close proximity (i.e. within two or three inches) of the keypad 104-108, a stimulus is used to activate the arm/disarm device 150-154 and/or keypad 104-108, initiating, communication between the arm/disarm device 150-154 and the keypad 104-108. If the, keypad 104-108 identifies the arm/disarm device 150-154 as an approved device, the system 100 may take further action, such as to change the mode from Armed Mode to Disarmed Mode, or vice versa. Therefore, the keypad, 104-108 consumes a low level of power while communicating with the arm/disarm device 150-154 and transmitting messages to the control panel 102 to control the arming and disarming of the system 100.

Figure 2:
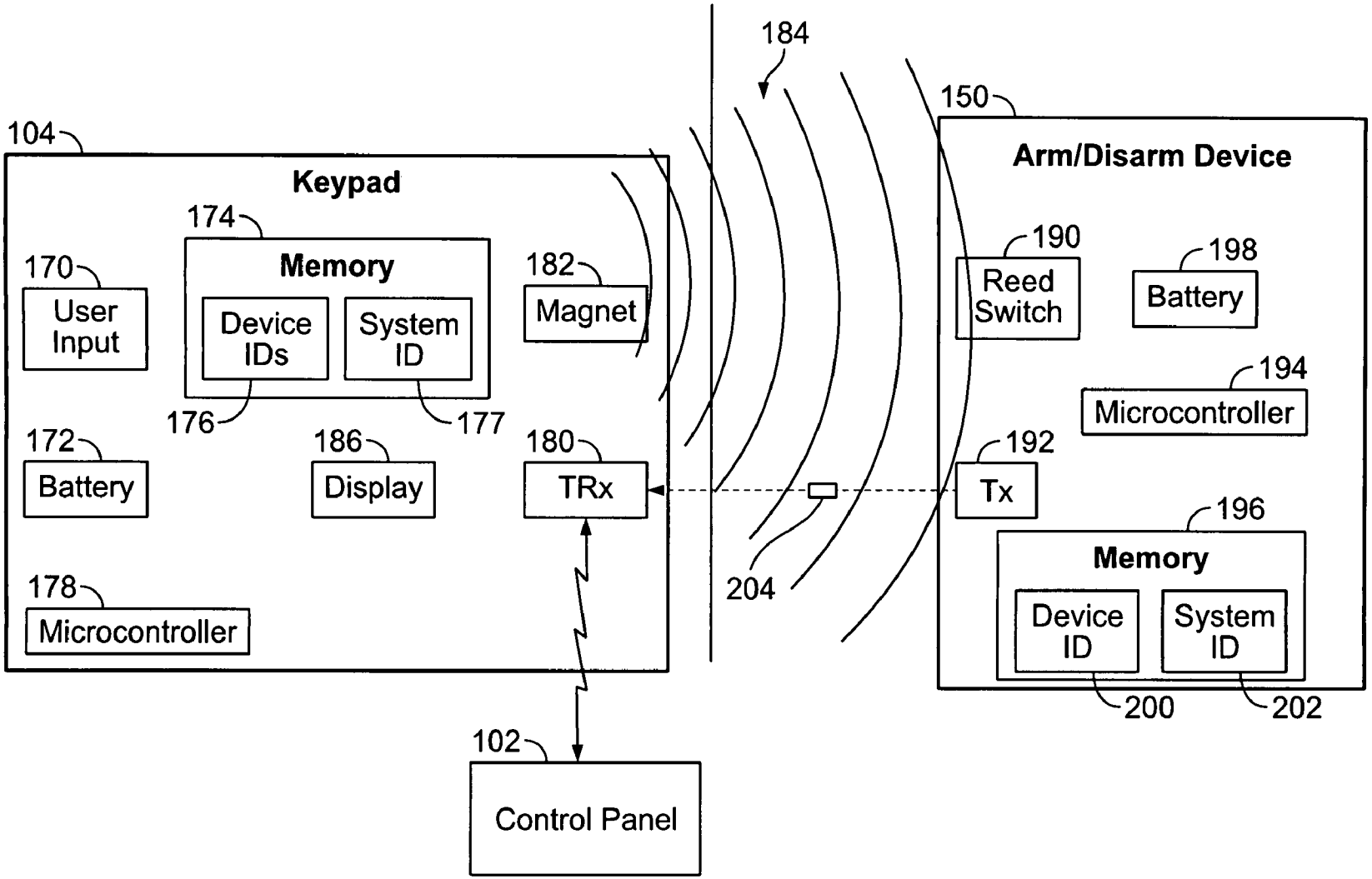
FIG. 2 illustrates an embodiment wherein a component within a keypad activates an arm/disarm device when the arm/disarm device is within a predetermined proximity of the keypad in accordance with an embodiment of the present invention.

FIG. 2 illustrates an embodiment wherein a component within the first keypad 104 activates the arm/disarm device 150 when the arm/disarm device 150 is within a predetermined proximity of the first keypad 104. The arm/disarm device 150 has an internal power source for powering at least some of the components within the arm/disarm device 150. The first keypad 104 operates in the periodic polling mode and senses the communication from the arm/disarm device. 150 with the keypad transceiver.

The first keypad 104 may have a user input 170 for manually entering codes, changing the mode of the system 160, entering configuration data, and the like. A display 186 may be used to display a status-or mode of the system 100, to display data that is entered using the user input 170, and/or to acknowledge receipt of a transmission from the arm/disarm device 150. A battery 172 provides power to the components. In another embodiment, the first keypad 104 may be hardwired to a power source. A flash or other non-volatile memory 174 stores data such as a list of approved device identifiers (IDs) 176 that are associated with approved arm/disarm devices. A system ID 177 identifying the system 100 may also be stored. A microcontroller 178 or other processor may be used to control the operation of the first keypad 104. Optionally, one or more LEDs (not shown) may be set to flash to indicate Armed and Disarmed Modes. Optionally the first keypad 104 may he provided with the ability to produce, a sound or chirp to indicate that the mode has been changed, acknowledge input, and the like.

An RF transceiver 180 in the first keypad 104 may also be referred to as the keypad transceiver. The transceiver 180 wirelessly transmits signals to and receives signals from the control panel 102 as well as receiving signals from the area around the first keypad 104, such as from the arm/disarm device 150. The transceiver 180 may operate in the industrial, scientific and medical (ISM) band, such as at 433/868 MHz, but is not limited to any particular frequencies or band of frequencies. By way of example only, the transceiver 180 may operate at 433.92 MHz, 868.35 MHz, within the 900 MHz band or within the 2.4 GHz band. During normal operation, the transceiver 180 periodically polls the environment, such as at 433 MHz, to sense any RF stimulus, such as a packet of RF data. For example, the transceiver 180 may operate in the periodic polling mode, having a sleep period of 500 ms followed by an active detection period of 4 ms. It should be understood that other lengths of sleep and active detection periods may be used. If an RF signal is detected from the control panel 102 or the arm/disarm device 150, the first keypad 104 may be switched to an active mode for at least a minimum period of time during which the first keypad 104 may process and act on the RF signal. If no, action is required and/or no further RF stimulus is detected by the first keypad 104 during the period of time, the first keypad 104 reverts to the periodic polling mode.

A permanent magnet 182 having a magnetic field 184 is installed within the first keypad 104. The magnetic field 184 extends beyond the first keypad 104 to cover an area proximate to the first keypad 104, such as two to three inches beyond the first keypad 104. The magnet 182 is a passive device that has static energy and thus does not require any current to operate. An indication (not shown) may be placed upon the cover of the first keypad 104 to indicate where the user should present the arm/disarm device 150, which may correspond to the approximate location of the magnet, 182 within the first keypad 104.

The arm/disarm device 150 has a reed switch 190, an RF transmitter 192, a microcontroller 194, a memory 196 and a battery 198. In some embodiments, the microcontroller 194 may be a radio frequency integrated circuit (RFIC) and the memory 196 may be integral to the RFIC. The reed switch 190, which is used to activate the arm/disarm device 150, is a passive component that does not require any current to operate. The battery 198 provides the power source for operating the other components within the arm/disarm device 150.

A device identifier (ID) 200 is stored in the memory 196 and is used to identify the particular arm/disarm device 150. The device ID 200 may be an identification code, token, or other security code that is used by the system 100 to authenticate the arm/disarm device 150. Each arm/disarm device 150 is pre authorized and may have its own unique device ID 200. A system ID 202 corresponding to the system ID 177 associated with the system 100 may also be stored in the memory 196. Other identifiers (not shown) may be stored, such as to increase the level of security. The memory 196 may be flash memory or other non-volatile memory. The information stored in the memory 196 is used by the arm/disarm device 150 to form RF data packets; herein referred to as device packets. It should be understood that although RF data packets are discussed, other forms of wireless communication may be used.

Most of the time the arm/disarm device 150 is in a dormant or sleep mode to conserve power. In the dormant mode, the battery 198 does not apply power to any of the components. When the arm/disarm device 150 is held within a predetermined proximity to the first keypad 104, such as within two to three inches of the magnet 182, the magnetic field 184 activates the reed switch 190. It should be understood that other components which may be activated by the magnetic field 184 may be used. When the reed switch 190 closes, a microcontroller interrupt and/or an RFIC interrupt is generated, and the microcontroller 194 and the transmitter 192 are activated or woken from the dormant mode and powered by the battery 198.

The microcontroller 194 then generates a device packet 204 that includes one or both of the device ID 200 and the system ID 202. The transmitter 192 then transmits a low power signal, that is, the device packet 204 is transmitted with a low level of RF transmit power. For example, in one embodiment the low level of transmit power may consume two milliamps (mA) or five mA, and in another embodiment, the low level of transmit power may consume within a range of one to seven mA. Because the arm/disarm device 150 and the first keypad 104 are in close proximity to each other, a much lower level of transmit power may be used compared to devices that transmit at longer distances and which may consume around 24 mA. The device packets,204 may be regularly generated and transmitted over a period of time. The low level of transmit power preserves the power in the battery 198, and thus the battery 198 has a longer life compared to RFID tags that transmit at higher levels of power in order to transmit RF packets over long distances. Also, the life of the battery 198 is extended compared to RFID tags that operate in a polling mode, transmitting on a regular basis regardless of the proximity of a keypad 104-108 or control panel 102.

In addition, the device packets. 204 may each be generated having a long preamble (i.e. RF message header). For example, the preamble may be longer than the sleep period of the transceiver 180 in the keypad. 104. Continuing the example above, the preamble may be longer than 500 ms so that the transceiver 180, operating in the periodic polling mode, will detect the device packet 204 quickly. A payload or data portion comprising the device ID. 200 and/or system ID 202 follows the preamble of the device packet 204. In one embodiment, the arm/disarm device 150 consumes approximately 1 mA when transmitting the device packet 204 at low power. Therefore, the arm/disarm device 150 consumes much less power in comparison with an RFID tag that is configured to transmit longer distances and which may consume 24 mA as previously discussed.

The transceiver 180 in the first keypad 104 detects the device packet 204 during the short active detection period. The transceiver 180 remains active until the entire device packet 204 has been received, which may be greater than 500 ms if the beginning of the preamble is detected during the active detection period. The microcontroller 178 compares the device ID 200 and/or the system ID 202 sent in the device packet 204 to the list of approved device IDs 176 and/or the system ID 177 stored in the memory 174. If the system and device IDs in the device packet 204 are the same as the system and device IDs stored in the memory 174, the arm/disarm device 150 is an approved device. It should be understood that a single ID or value may be sent in the device packet 204 and compared to a single value stored in the memory 174.

The microcontroller 178 in the keypad 104 prepares and the transceiver 180 transmits a message, which may be, an RF data packet or an RF packet based message, to the control panel 102 telling the control panel 102 to arm or disarm the system 100. The control panel 102 may then change the mode of the system 100 without input from the person holding the arm/disarm device 150. In another embodiment, the transceiver 180 may transmit the data in the device packet 204 received from the arm/disarm device 150 to the control panel 102, and the control panel 102 may determine if the arm/disarm device 150 is an approved device. After sending the message to the control panel 102, the keypad 104 again operates in the periodic polling mode.

If one or both of the device ID 200 and the system ID 202 do not match the values stored in the memory 174, the device packet 204 may be discarded. If the values do not match, the arm-disarm device 1 50 may be associated with a different security system or may no longer be approved. For example, the device ID 200 may be removed from the list of approved device IDs 176 if an employee is no longer employed at the facility or if the arm/disarm device 150 is lost or 'stolen.

In another embodiment, the device packet 204 of the arm/disarm device 150-154 may be used to track personnel. For example, instead of changing a mode of the system 100, the microcontroller 178 may log the presence of approved devices 150-154, such as to track when personnel enter and leave the premises.

Figure 3:
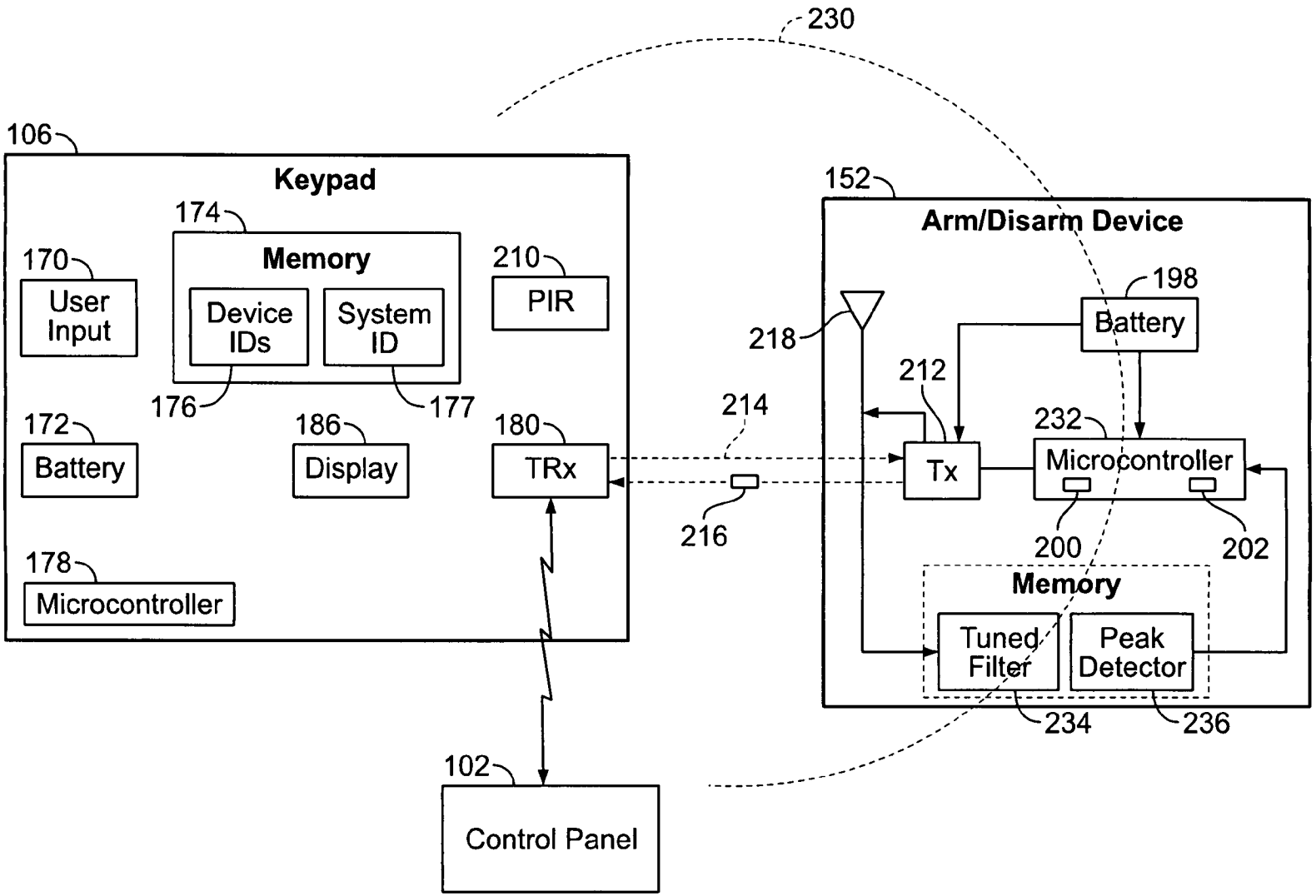
FIG. 3 illustrates an embodiment wherein the keypad senses infrared energy when the arm/disarm device is held within a predetermined proximity of the keypad and transmits a signal to activate the arm/disarm device in accordance with an embodiment of the present invention.

FIG. 3 illustrates an embodiment wherein the second keypad 106 senses infrared energy when the arm/disarm device 152 is held within a predetermined proximity of the second keypad 106 and transmits a signal to activate the arm/disarm device 152. The arm/disarm device 152 may be referred to as a semi-passive device, passively sensing F energy in the environment while having a battery source to power a transmitter. In another embodiment, the arm/disarm device 152 may utilize an active circuit to sense RF energy wherein the active circuit consumes a very low level of power such as a low power sniffing mode.

Similar components between the first and second keypads 104 and 106 are indicated with like item numbers and will not be discussed in detail. For example, the second keypad 106 may have the user input 170, the battery 172, the memory 174 storing the list of approved device IDs 176 and the system ID 177, the microcontroller 178, the RF transceiver 180 and the display 186. The second keypad 106 operates in the periodic polling mode as discussed previously.

To sense the proximity of the arm/disarm device 152, a passive infrared (PIR) sensor 210 is installed within the second keypad 106. The PIR sensor 210 detects infrared energy as heat or temperature changes within a predetermined proximity 230 to the PIR sensor 210. The PIR sensor 210 may sense or sample the temperature continuously within a range of two to three inches, consuming a very low level of power. Alternatively, the PIR sensor 210 may sense the temperature periodically. Based on the sampling, the microcontroller 178 may establish a background temperature. The microcontroller 178 may track the temperature samples until a minimum temperature change has occurred within a predetermined time period or number of samples. For example, if the temperature rises at least three degrees over approximately two seconds, the microcontroller 178 may determine that infrared energy is being radiated from a person's hand that is holding the arm/disarm device 152 close to the second keypad 106. It should be understood that other minimum temperature changes may be used, and that the minimum temperature change may also be based on the background temperature.

The arm/disarm device 152 comprises the battery 198, an RF transmitter 212, an antenna 218, and a microcontroller 232 that stores the device ID 200 and the system ID 202 therein. Passive circuitry comprises a tuned filter 234 and a peak detector 236. The arm/disarm device 152 both transmits and receives RF energy and/or RF packets.

When the microcontroller 178 determines that the PIR sensor 210 has detected a change in temperature or infrared energy, the microcontroller 178 activates the transceiver 180 from the periodic polling mode. The transceiver 180 then transmits a burst of RF energy 214 that has a specific frequency, such as 433 MHz. The power level of the burst of RF energy 214 can be very low, such as consuming, within one to seven mA of current, as the arm/disarm device 152 is held close to the second keypad 106, such as within two to three inches. The low level helps to conserve power within the battery 172 of the second keypad 106.

When not activated, the transmitter 212 and the microcontroller 232 within the arm/disarm device 152 do not consume battery power. The antenna 218 is a passive (i.e. not powered by the battery 198) device that detects RF energy. Therefore, the antenna 218, receives RF energy from the transceiver 180. The tuned filter 234 responds to a particular frequency or range of frequencies, such as 433 MHz or 868 MHz, such as the burst of RF energy 214 from the transceiver 180. As discussed previously, other frequencies and ranges of frequencies may be used. The peak detector 236 detects a voltage peak when the tuned filter 234 receives the desired frequency, and outputs a trigger, interrupt or RFIC interrupt to wake up the microcontroller 232. The microcontroller 232 and transmitter 212 are powered by the battery 198, and the microcontroller 232 prepares an RF device packet 216 having the device ID 200 and/or the system ID 202; as discussed previously. The transmitter 212 transmits the device packet 216 With a low level of energy, such as to consume between one an d seven mA of current, which is received by the keypad transceiver 180. The device packet 216 may have the long preamble, such as to be longer than the sleep period of the keypad 106, as discussed previously. The low level of transmit energy conserves the power within the battery 198. The microcontroller 178 in the second keypad 106 then determines whether the arm/disarm device 152 is an approved device and transmits a message to the control panel 102, indicating that the system 100 should be armed or disarmed as discussed previously.

Figure 4:
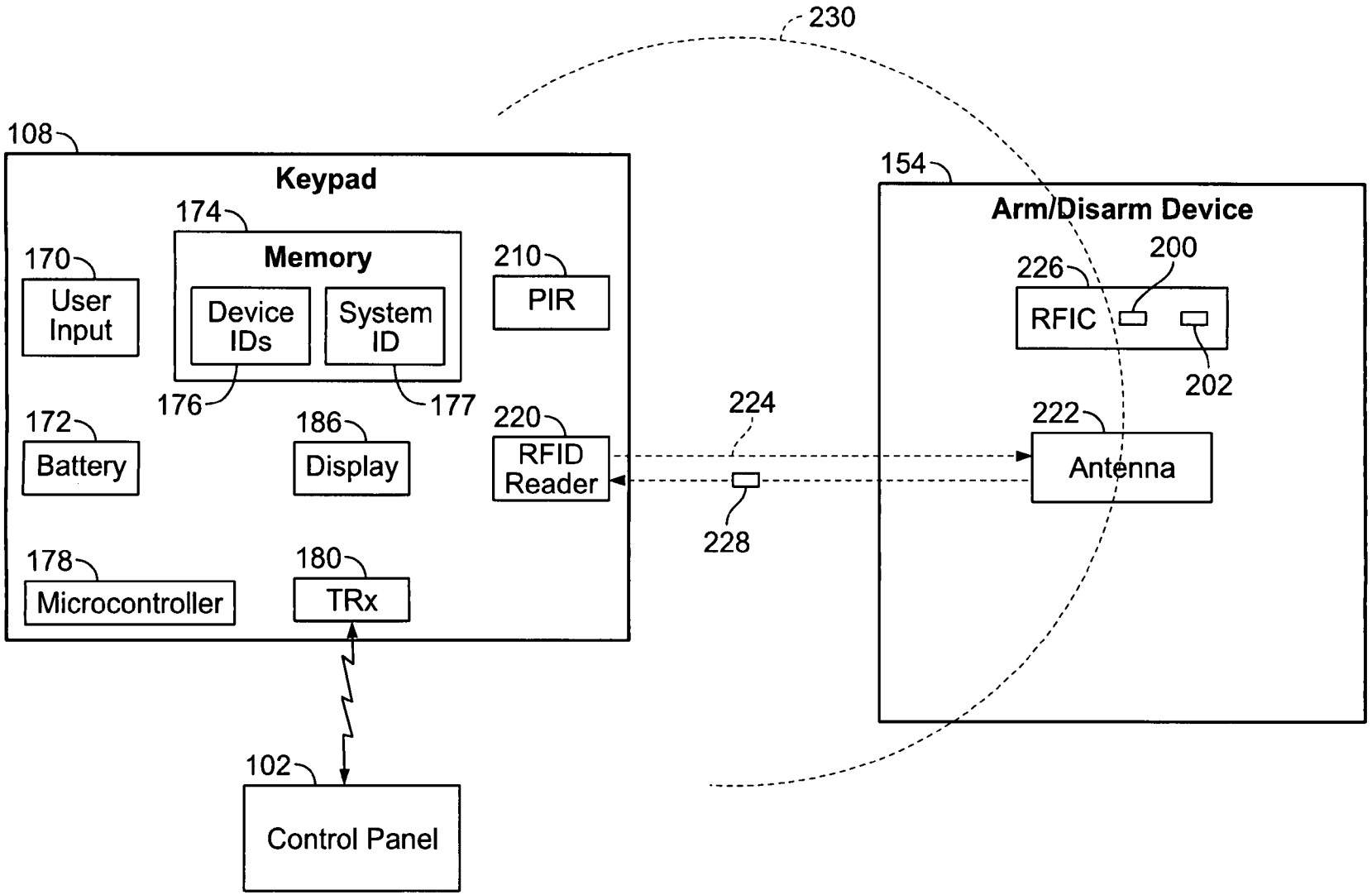
FIG. 4 illustrates another embodiment wherein the keypad senses infrared energy when the arm/disarm device is held within a predetermined proximity of the keypad and transmits a signal to activate the arm/disarm device in accordance with an embodiment of the present invention.

FIG. 4 illustrates another embodiment wherein the third keypad 108 senses infrared energy when the arm/disarm device 154 is held within a predetermined proximity 230 of the third keypad 108 and transmits a signal to activate the arm/disarm device 154. The arm/disarm device 154 is a passive device that does not have an internal source of power, such as a battery. In one embodiment, the arm/disarm device 154 may be passive RFID tag. In the third keypad 108, an RFID reader 220 transmits the signal to activate and power the arm/disarm device 154.

Similar components between the first, second and third keypads 104-108 are indicated with like item numbers and will not be discussed in detail. The third keypad 108 may have the user input 170, the battery 172, the memory 174 storing the list of approved device IDs 176 and the system ID 177, the microcontroller 178, the RF transceiver 180, the display 186 and the PIR sensor 210. The transceiver 180 in the third keypad 108 may operate in the periodic polling mode as discussed previously while the RFID reader 220 operates in, a dormant mode. Therefore, the RFID reader 220 does not poll the environment periodically. The RFID reader 220 may be configured to operate at 13.56 MHz but is not so limited. For example, the RFID reader 220 may operate at any frequency within the ISM band.

When the microcontroller 178 determines that a predetermined change in IR energy is sensed by the PIR sensor 210 (as discussed previously with respect to FIG. 3), the microcontroller 178 activates or wakes up the RFID reader 220. The RFID reader 220 then transmits a burst of RF energy 224 at a specific frequency, such as 13.56 MHz, at a predetermined power level. The power level may be low, consuming, for example, between seven and nineteen mA of current, as the arm/disarm device. 154 is held close to the third keypad 108. The RHD reader 220 may then operate in an activated mode, such as always on, or a periodic polling mode.

Turning to the arm/disarm device 154, an antenna 222 operates as a transceiver. The antenna 222 collects power from the burst of RF energy 224. An RFIC 226 is activated and powered by the energy collected by the antenna 222, and prepares an RF devices packet 228 for transmission. The device ID 200 and/or system ID 202 are stored within the RFIC 226 or within an optional memory that may be separate from the RFIC 226 (not shown). The antenna 222 then transmits the device packet 228 which is received by the RFID reader 220. The device packet. 228 may have the long preamble (i.e. 500 ms) as discussed previously.

The device packet 228 is detected by the RFID reader 220 and processed as discussed above. If the device ID 200 is on the list of approved device IDs 176 and/or the system ID 202 matches the system ID 177, the arm/disarm device 154 may be approved and the transceiver 180 transmits a message to the control panel 102, telling the control panel 102 to either arm or disarm the system 100. The transceiver 180 then returns to the periodic polling mode and the RFID reader 220 returns to a dormant mode, conserving power within the third keypad 108.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means plus function format and are not intended to be interpreted based on 35 U.S.C. §112, sixth paragraph, unless and until such claim limitations expressly use the phrase "means for" followed by a statement of function void of further structure.

What is claimed is:

1. A security system, comprising:

a control panel configured to control devices in a security system;

a keypad in communication with the control panel, the keypad comprising:

a transceiver;

a passive infrared (PIR) sensor configured to detect temperature within a predetermined proximity of the PIR sensor, the transceiver transmitting an RF signal when the PIR sensor detects a minimum temperature change; and an arm/disarm device configured to receive the RF signal from the transceiver, the arm/disarm device comprising a transmitter configured to transmit a low power RF device packet to the transceiver, the low power RF device packet comprising at least one identifier for identifying the arm/disarm device, the, keypad further configured to transmit a message to the control panel based on the low power RF device packet, the control panel further configured to determine one of an Armed Mode and Disarmed Mode for the system based on the message.

2. The security system of claim 1, wherein the transceiver is a 433/868 MHz transceiver.

3. The security system of claim 1, wherein the transceiver further comprises:

a keypad transceiver; and an RFID reader, wherein the keypad transceiver is configured to communicate with the control panel and the RFID reader is configured to transmit the RF signal when the PIR sensor detects the minimum temperature change.

4. The security system of claim 1, wherein the transceiver further comprises:

a keypad transceiver configured to communicate with the control panel; and an RFID reader configured to transmit the RF signal when the PIR sensor detects the minimum temperature change, wherein the RFID reader is further configured to be dormant prior to transmitting the RF signal, the RFID reader further configured to detect the low power RF device packet.

5. The security system of claim 1, wherein the arm/disarm device further comprises a battery configured to power the transmitter, wherein the transmitter is further configured to be in an off mode prior to receiving the RF signal and in an activated mode for a period of time after receiving the RF signal.

6. The security system of claim 1, wherein the transceiver is configured to transmit the RF signal at a low power to be detectable within the predetermined proximity, wherein the predetermined proximity is up to three inches from the PIR sensor.

7. The security system of claim 1, wherein the RF signal is a burst of RF energy consuming current within a range of one mA to 7 mA.

8. The security system of claim 1, wherein the arm/disarm device is a passive RFID tag.

9. The, security system of claim 1, wherein the transceiver is further configured to operate in a periodic polling mode.

* * * * *

UNITED STATES PATENT AND TRADEMARK OFFICE

CERTIFICATE OF CORRECTION

PATENT NO. : 7,859,404 B2
APPLICATION NO. : 12/141574
DATED : December 28, 2010
INVENTOR(S) : Chul Lee et al.

It is certified that error appears in the above-identified patent and that said Letters Patent is hereby corrected as shown below:

Claim 1,
Line 17,
Whereas, "the, keypad further" should be corrected to read "the keypad further"

Claim 9,
Line 1,
Whereas, "The, security system" should be corrected to read "The security system"

Signed and Sealed this
Fifteenth Day of February, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,859,404 B2
APPLICATION NO. : 12/141574
DATED : December 28, 2010
INVENTOR(S) : Chul Lee et al.

It is certified that error appears in the above-identified patent and that said Letters Patent is hereby corrected as shown below:

Column 10, line 18 (Claim 1, line 17)
Whereas, "the, keypad further" should be corrected to read "the keypad further"

Column 10, line 59 (Claim 9, line 1)
Whereas, "The, security system" should be corrected to read "The security system"

This certificate supersedes the Certificate of Correction issued February 15, 2011.

Signed and Sealed this
Fifteenth Day of March, 2011

David J. Kappos

David J. Kappos
*Director of the United States Patent and Trademark Office*